United States Patent [19]

Huang

[11] Patent Number: 4,520,350

[45] Date of Patent: May 28, 1985

[54] MAIL BOX WITH REMOTE INDICATOR

[76] Inventor: Henry C. Huang, 12 Traymore St., Cambridge, Mass. 02140

[21] Appl. No.: 419,961

[22] Filed: Sep. 20, 1982

[51] Int. Cl.[3] ..... G08B 21/00

[52] U.S. Cl. ..... 340/569; 232/37; 340/691

[58] Field of Search ..... 340/569, 691; 232/35-37

[56] References Cited

U.S. PATENT DOCUMENTS

| | | | |
|---|---|---|---|
| 837,770 | 12/1906 | Allen | 340/569 |
| 1,976,117 | 10/1934 | Cassel | 340/569 |
| 2,438,785 | 3/1948 | McKallick | 340/569 X |
| 3,611,333 | 10/1971 | Conigliaro | 340/569 X |
| 4,048,850 | 9/1977 | Ramberg et al. | 340/691 X |
| 4,287,514 | 9/1981 | Wartman et al. | 340/569 |

FOREIGN PATENT DOCUMENTS

| | | | |
|---|---|---|---|
| 507682 | 11/1954 | Canada | 340/569 |

*Primary Examiner*—Glen R. Swann, III
*Assistant Examiner*—Thomas J. Mullen, Jr.
*Attorney, Agent, or Firm*—E. Thorpe Barrett

[57] ABSTRACT

The invention relates to a mail box alarm system arranged to notify the owner of a rural mail box when mail has been received. A transmitter positioned in the mail box radiates a coded signal each time the door of the box is opened or closed. A receiver, positioned in the associated residence or business, operates a visual and audible alarm. When mail is delivered, both the visual and audible alarm are energized during the time the door is open for the delivery of mail. When the door is closed, only the visual alarm remains energized. When the mail is picked up, the visual alarm is automatically deenergized and the mechanism re-positioned for a new cycle.

3 Claims, 4 Drawing Figures

MAIL BOX WITH REMOTE INDICATOR

BACKGROUND OF THE INVENTION

1. Field of the Invention

This invention relates to a rural mail box with automatic status indication at a remote point. In particular, it relates to a mail box having remote transitory and longer term announcers denoting that mail has been delivered to the mail box.

2. Description of the Prior Art

A wide variety of mail boxes has been designed for use in rural areas. Generally, it has been the province of the owner to determine by visual examination whether a particular delivery of the mail has been made. To assist in this determination, a movable flag is usually provided with the mail box. Upon delivery of the mail, the mailman rotates the flag to its vertical position to indicate that mail has been left in the box. This simple system requires that an owner who is anxious to know about a delivery keep the flag under more or less continual surveillance. This attendance is particularly difficult when the mailbox is located out of direct view from the house or business for which the mail is intended. No practical alarm system has yet been provided for producing, within the residential or business building, a visual and audible alarm, indicating the receipt of mail.

SUMMARY OF THE INVENTION

The present invention provides an automatic indication of the status of mail delivery and gives this indication both visually and audibly within the residence. The mail box is equipped with a radio transmitter that responds to the opening of the mail box by the mail man for the delivery of the mail by sounding an audible alarm within the residence. At the same time, an indicator light is energized. When the mailman closes the mail box, after the delivery of the mail, the audible alarm ceases, but the visual indicator continues to be energized. When the recipient opens the mail box to get the mail, the visual alarm is automatically extinguished. The transmitter located at the mail box is powered by a conventional battery power pack. In order to extend the life of the batteries, the transmission makes use of a short coded system that repsonds to a momentary impulse generated each time the mail box is opened or closed. When the door of the mail box is either fully open or closed, it is impossible for any signal to be transmitted. The life of the battery pack is accordingly very long.

The indicator flag of the mail box performs its usual functions, that is, to notify the mailman that there is mail in the box to be picked up and to notify the recipient that mail has been left in the box by the mail man. The flag indication may thus be ambiguous for the recipient who has left mail to be picked up: he cannot tell from the position of the flag whether the mail has yet been delivered. This ambiguity is eliminated by the present invention. In addition to the usual functions of the flag, it is arranged to operate an interrupt switch that prevents the transmitter from being energized whenever the flag is in its vertical position. When the flag is in its vertical position to indicate to the mail man that there is mail in the box to be picked up, the mail man will, before opening the mail box, return the flag to its horizontal position, restoring the power circuit for the transmitter. Then when the box is opened the momentary impulse will be transmitted causing the receiving mechanism in the residence or business to advance by one increment. When the box is closed, the receiving mechanism will be advanced by one additional cycle. These successive impulses are arranged by a switch mechanism to energize the appropriate alarms. After the mailman has left the mail and closed the mail box, it is not important whether he again raises the flag to its vertical position: the visual alarm will continue to be energized.

In the event there is outgoing mail, but the mailman has no mail for delivery, the flag will be in its vertical position when the mailman arrives. In this position, the power to the transmitter is interupted, so the mailman opens the box before lowering the flag, removes the mail, closes the box, and lowers the flag to its horizontal position. With this operating sequence, no signal is sent to the residence or business indicating to the recipient that no mail was received.

In the event the mailman is delivering important mail, that does not require a personal signature, the mailman may open the mail box with the flag in the vertical position (no signal is transmitted), leave the mail, lower the flag to its horizontal position, and close the mail box (a signal pulse is transmitted). This transmission of a single pulse, instead of the usual two-pulse code, causes the audible alarm to continue until the mail is picked up by the recipient.

DESCRIPTION OF THE PREFERRED EMBODIMENT

Figure 1:
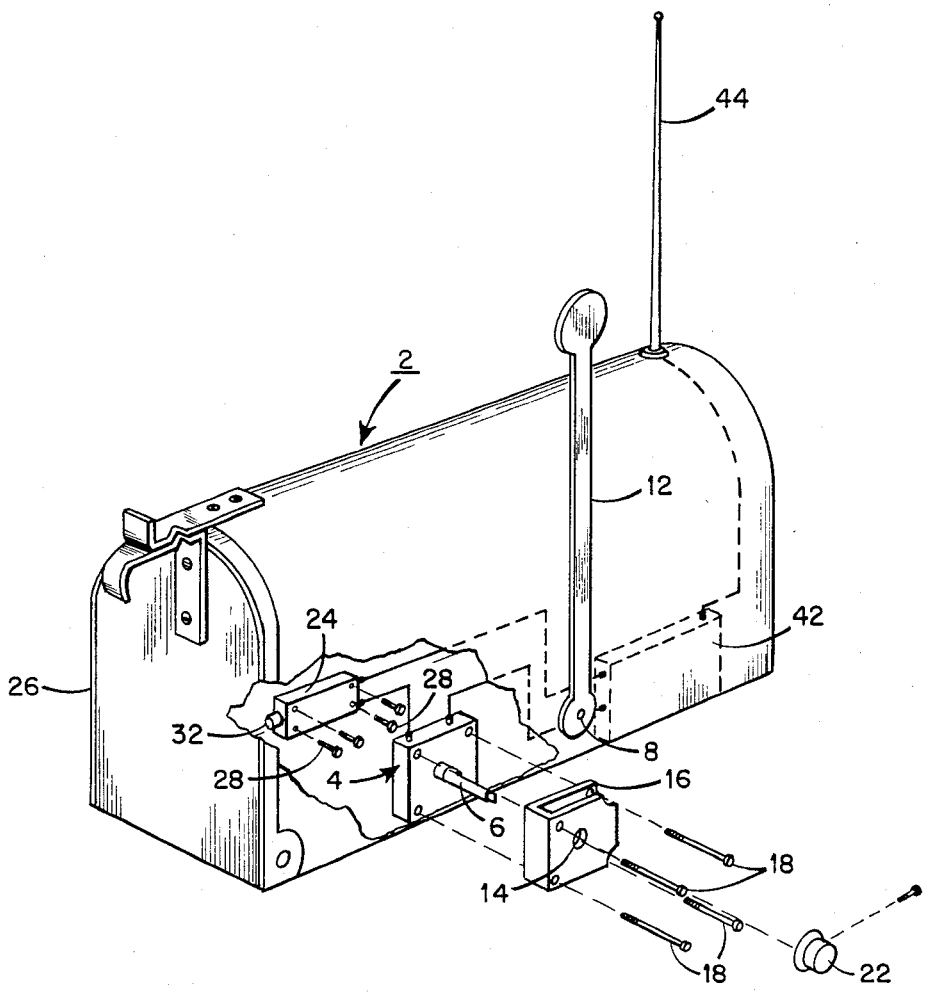
FIG. 1 is a diagrammatic view in perspective of a mail box incorporating the transmitter circuits.

As shown in FIG. 1, a mail box, generally indicated at 2, is equipped with a rotary interrupt switch 4 having a flatted shaft 6 that extends outwardly through the side of the mail box 2 and engages a correspondingly shaped opening 8 in the base of a signal flag 12 that performs, in addition to the functions set forth herein, the conventional functions of such a signal flag. The shaft 6 passes through a pair of bearing openings, as indicated at 14, in a support frame 16 mounted on the outside of the box 2. The shaft 6 thus serves as a supporting axle for the flag 12 permitting it to be moved between its vertical and horizontal positions. When the flag 12 is moved from its horizontal to its vertical position, the rotation of the shaft 6 causes the switch 4 to move from its closed to its open position. The support frame 16 is secured to the mail box 2 by four screws 18 that pass through suitable openings in the frame 16 and in the side of the mail box 2 into threaded engagement with the case of the interrupt switch 4. A cap 22 provides weather protection for the shaft 6.

The mail box 2 is provided also with an impulse switch 24 arranged to be closed momentarily each time the door 26 of the mail box 2 is moved between its open and its closed positions. The switch 24, which may be secured to the inner surface of the mail box 2 by screws 28, is provided with a longitudinally movable plunger 32 that engages the inner surface of the door 26 and holds the switch 24 in its open position when the door 26 is in its closed position. The plunger 32 is biased toward its fully extended position by a spring 33.

When the door of the mail box is opened, the spring 38 forces the plunger 32 outwardly. During this outward travel of the plunger, two contact members 34 and 36 (FIG. 2) are momentarily placed in electrical communication. When the plunger 32 is in either its fully extended position or its fully retracted position, the circuit through the switch 24 is open.

Figure 2:
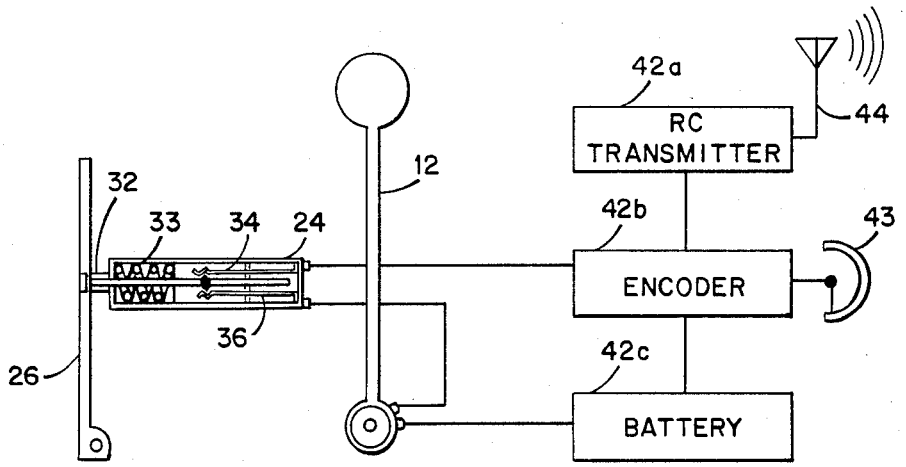
FIG. 2 is a schematic diagram of the transmitting circuits.

The mail box 2 also houses a transmitter 42 that includes transmitting circuits, an encoder and a battery supply, indicated respectively in block form at 42*a*, 42*b* and 42*c* in FIG. 2. The encoder 42*b* includes a manually operable code selector that controls the particular code to be transmitted. The transmitter is connected to an antenna extending from the top of the mail box 2.

The transmitting and receiving circuits are not described in detail here since they are well known in the art and are well within the skill of the usual engineer in this field. Generally, the receiving and transmitting circuits may be such as are commonly used for the control of garage doors.

Each time power is applied to the transmitter 42, the antenna 44 radiates a coded signal that indicates the change in the status of the mail box 2. Under the most usual operating circumstances, two signals are transmitted each time the mail box is opened.

Figure 3:
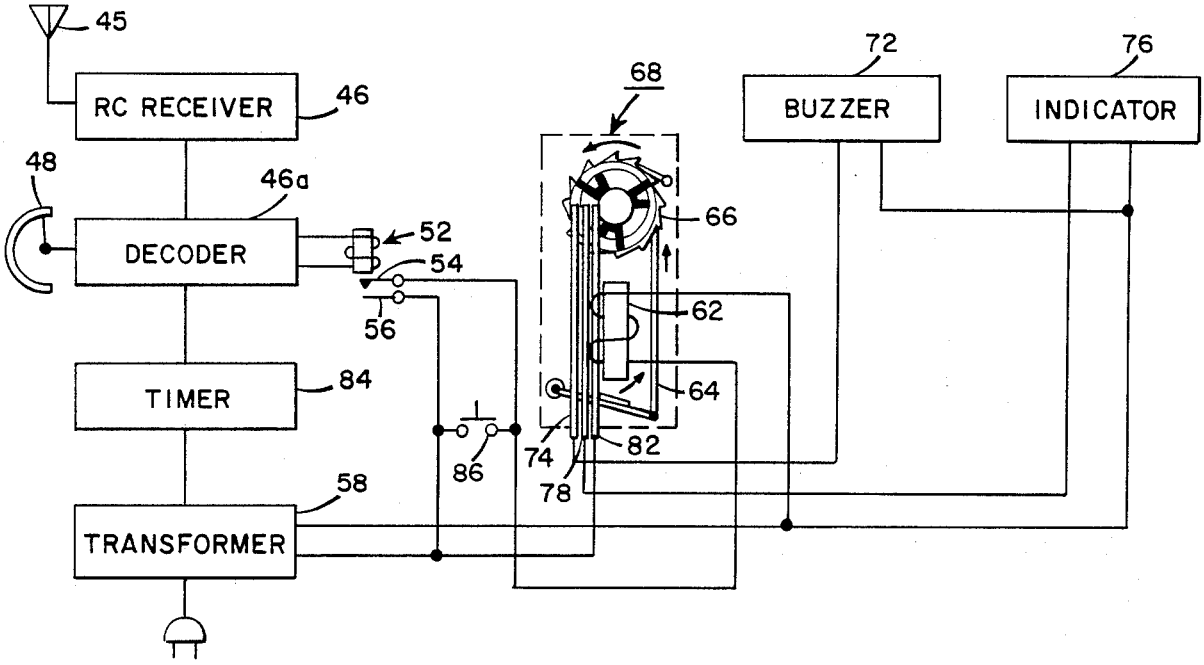
FIG. 3 is a schematic representation of the receiving circuits.
Figure 4:
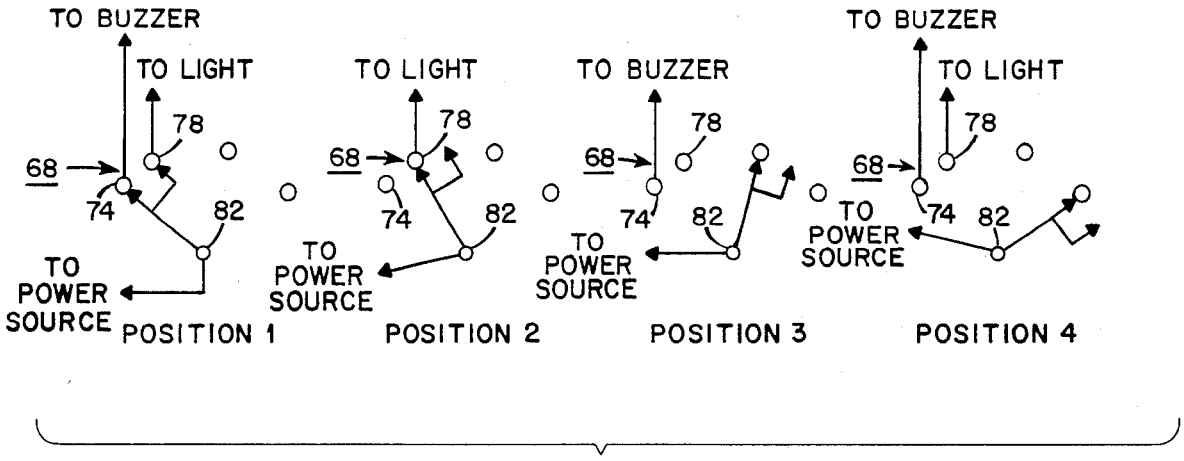
FIG. 4 is a diagrammatic representation of the four repeating positions of a switching commutator.

A remotely located receiving system is shown in schematic form in FIGS. 3 and 4. The signal from the transmitting antenna 44 is received by a receiver 46 that includes a decoder 46*a* and a code selector switch 48. The output from the decoder operates a relay 52, or any other equivalent power amplifying device, that controls a pair of contacts 54 and 56. When the relay 52 is actuated by receipt of a signal from the mail box, the contacts 54 and 56 are closed completing a circuit from a transformer 58 that also provides power for the receiver 46, to an armature drive mechanism 62. When the armature 62 is energized, it causes an armature arm 64 to rotate a commutator 66 of a four-position stepping switch, generally indicated at 68, one position (counterclockwise as viewed in FIG. 3). After rotation of the commutator 66 through four positions, the sequence of switching changes is repeated.

An audible alarm, such as a buzzer 72, is connected to a contact 74 and a visual indicator, such as a light 76, is connected to a contact 78 of the stepping or commutator switch 68. The common contact 84 of the switch 68 is connected to one terminal of the transformer 58.

The four positions of the commutator switch 68 are shown diagrammatically in FIG. 4. In Position 1, the power source 58 is connected through the terminal 74 to the buzzer 72 and the terminal 78 to the light 76. In Position 2, the buzzer 72 is disengaged, but the light continues to be energized. In Positions 3 and 4, neither the light or the buzzer is energized. Between mail deliveries, the switch 68 is in Position 4. When the mail box is opened, the switch leaves Position 4, returns to Position 1, and the cycle is repeated. This cyclic operation is designed to meet the requirements of the different circumstances relating to the sending and receipt of mail.

Condition 1: The recipient leaves mail for the mail man. The switch 68 is in the Position 4 of FIG. 4 so that neither the audible indicator 72 nor the light 76 are energized. Before opening the mail box, the flag is raised to its vertical alert position, interrupting the power circuits for the transmitter 42, the door is opened, the mail is inserted, and the door is closed. The flag remains in its upright or alert position to notify the mailman of the presence of mail to be picked up. During this sequence of events, no signals are transmitted and the switch 68 remains in Position 4 as shown in FIG. 4.

Condition 2: The mail man arrives with mail to be delivered and mail in the box to be picked up. The mailman lowers the flag to its horizontal or non-alert position before opening the mail box, to restore the power to the transmitting circuits, opens the mail box door 26, causing a coded signal to be transmitted that steps the commutator switch 68 from its Position 4 to its Position 1 energizing both the buzzer 72 and the light 76, picks up the outgoing mail and leaves the incoming mail, and closes the mail box, causing another coded signal to be transmitted, stepping the switch 68 to its Position 2. In this position, the buzzer 72 is turned off, but the light 76 remains on.

Condition 3: There is outgoing mail, but the mailman has no mail to be delivered. The flag will be in its vertical position when the mailman arrives so that the transmitter circuits are deenergized. The commutator switch 68 will be in its Position 4. The mailman opens the box with the flag in its vertical position so that no signal is transmitted, opens the mail box, picks up the mail, closes the mail box, and lowers the flag to restore power to the transmitting circuits. The switch 68 remains in its Position 4 so that no alarms are energized and the recipient is made aware that no mail has been delivered.

Condition 4: The recipient picks up mail from the mail box. In each of the above conditions, when mail has been delivered, the commutator switch 68 will be in its Position 2. The recipient first lowers the flag from its alert position to its horizontal or non-alert position, restoring power to the transmitting circuits, opens the mail box door 26, causing the transmission of a coded signal that advances the commutator switch 68 from its Position 2 to Position 3 and turns off light 76, removes the mail, and closes the mail box door 26 causing another signal to advance the switch 68 to Position 4.

Condition 5: There is no outgoing mail, but the mailman has urgent mail to be delivered and desires to indicate that urgency to the recipient. The mailman opens the mail box 2 with the flag 12 in its horizontal position, so that a coded signal is transmitted stepping the switch 68 from its Position 4 to its Position 1 and energizing the buzzer 72 and the light 76, leaves the important mail in the box, lifts the flag 12 to its vertical alert position, interrupting the power to the transmitter, and then closes the door 26. No signal is transmitted, so the switch 68 remains in its Position 1 and both the light 76 and the buzzer 72 remain energized to indicate to the recipient the important nature of the mail.

Condition 6: The recipient picks up the important mail. The flag is first lowered to its horizontal position to restore power to the transmitter 42, the door 26 is opened, causing a single plus to be transmitted, the mail is removed, and the box is closed, causing a second pulse to be transmitted. These two pulses, step the commutator switch 68 from its Position 1 to its Position 3, deenergizing both the light 76 and the buzzer 68.

This last sequence of events, however, has left the switch 68 in its Position 3, but the correct position for the initiation of a new cycle is Position 4. To return the mechanism to its proper cycle position, the recipient, after picking up the important mail, presses a push-button switch 86 to apply an impulse to the commutator switch 68 and cause it to advance to its Position 4. The switch 86 is used for initial adjustment and at any later time to reset the cyclic position of the system, which may be incorrect because of improper procedure, power failure, or other cause. The plunger 32 may be operated manually at the mail box to perform the same functions as the switch 86.

The receiving circuits, because they are located in a residence or business building, are ordinarily powered from conventional lighting circuits through the power transformer 58. The transmitter, in the mail box 2, has a very short duty cycle and can be operated on a single battery pack for a long period of time without replacement. The receiver circuits, however, must be operated continuously in order to receive a signal from the mail box 2 whenever it is transmitted. Nevertheless, in most areas, mail is delivered only during limited times of the day. A timer 84 is therefore provided that can be adjusted to energize the receiving circuits only during those hours when mail delivery is to be expected. This results in power savings and prolongs the life of the receiving equipment.

From the foregoing it will be seen that my invention provides a practical and useful answer to a persistent problem, that practical embodiments may be readily and economically manufactured using conventional materials and techniques, and that they are subject to a variety of modifications without departing from the spirit and scope of my invention.

I claim:

1. A mail box alarm system comprising a mail box having a door manually movable between open and closed positions and a signal flag manually movable between first and second positions, said signal flag being positioned substantially vertically in an alert position when in its said first position and in a substantially horizontal position in a non-alert position when in its said second position, a transmitter associated with said mail box, a power source having a connection to said transmitter, an antenna coupled to said transmitter, an interrupt switch operated by movement of said signal flag and arranged to prevent radiation by said transmitter when said signal flag is in its first position, transmitter control means responsive to the movement of said door arranged to cause said transmitter to radiate a signal each time said door is moved between its said open and closed positions when said flag is in its said second position, said transmitter control means including an impulse switch connected in series with said interrupt switch between said power source and said transmitter and arranged to interrupt said connection between said power source and said transmitter when said door is in either its closed or open position and to complete said connection when said door is at a position between its said open and closed positions, a receiver remotely positioned from said transmitter arranged to respond to signals radiated by said transmitter, alarm means including a visual alarm and an audible alarm coupled to said receiver, and a multiple-position stepping switch coupled to said receiver and said alarm means, wherein said stepping switch is arranged to be advanced through a repeating succession of positions by the received signals, and said alarm means are selectively energized in accordance with the position of said stepping switch.

2. A mail box alarm system as claimed in claim 1 wherein said stepping switch is arranged in response to a signal produced by the opening of said door to energize both said visual alarm and said audible alarm, and to a successive signal produced by the closing of said door to deenergize said audible alarm while continuing to energize said visual alarm.

3. A mail box alarm system as claimed in claim 2 including manually operated switch means for advancing said stepping switch independent of the operation of said transmitter.

* * * * *